US008109625B2

(12) United States Patent
Fukui

(10) Patent No.: US 8,109,625 B2
(45) Date of Patent: Feb. 7, 2012

(54) APPLICATION APPARATUS AND INKJET RECORDING APPARATUS

(75) Inventor: Takashi Fukui, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 385 days.

(21) Appl. No.: 12/402,097

(22) Filed: Mar. 11, 2009

(65) Prior Publication Data

US 2009/0231405 A1 Sep. 17, 2009

(30) Foreign Application Priority Data

Mar. 12, 2008 (JP) ..... 2008-062824

(51) Int. Cl.
*B41J 2/01* (2006.01)

(52) U.S. Cl. ..... 347/102; 347/101; 347/103

(58) Field of Classification Search ..... 347/103, 347/102, 101, 100, 88, 99
See application file for complete search history.

(56) References Cited

U.S. PATENT DOCUMENTS

| | | | | |
|---|---|---|---|---|
| 6,196,675 | B1 * | 3/2001 | Deily et al. | 347/103 |
| 6,318,853 | B1 * | 11/2001 | Asano et al. | 347/103 |
| 6,341,854 | B1 | 1/2002 | Takemoto | |
| 6,585,364 | B2 * | 7/2003 | Kasperchik et al. | 347/98 |
| 6,715,866 | B2 | 4/2004 | Kasperchik et al. | |
| 8,011,781 | B2 | 9/2011 | Taniuchi et al. | |
| 2004/0041892 | A1 * | 3/2004 | Yoneyama et al. | 347/102 |
| 2005/0110857 | A1 | 5/2005 | Matsumoto et al. | |
| 2005/0179760 | A1 * | 8/2005 | Nakagawa et al. | 347/105 |
| 2008/0006176 | A1 | 1/2008 | Houjou | |

FOREIGN PATENT DOCUMENTS

| | | | |
|---|---|---|---|
| JP | 62-298477 | A | 12/1987 |
| JP | 2000-37942 | A | 2/2000 |
| JP | 2003-011353 | A | 1/2003 |
| JP | 2004-291627 | A | 10/2004 |
| JP | 2006-110445 | A | 4/2006 |
| JP | 2007-83180 | A | 4/2007 |
| JP | 2007-117806 | A | 5/2007 |
| JP | 2007/331169 | A | 12/2007 |
| JP | 2008-018716 | A | 1/2008 |
| JP | 2008/019286 | A | 1/2008 |
| JP | 2008/030390 | A | 2/2008 |

* cited by examiner

*Primary Examiner* — Manish S Shah
(74) *Attorney, Agent, or Firm* — Birch, Stewart, Kolasch & Birch, LLP

(57) ABSTRACT

An application apparatus has: a supply device which supplies a liquid in which a treatment agent having a prescribed function is dissolved; an application device which applies the liquid supplied from the supply device, onto a medium; and a condensing device which condenses the liquid supplied to the application device from the supply device during a period until the liquid is applied to the medium.

11 Claims, 8 Drawing Sheets

APPLICATION APPARATUS AND INKJET RECORDING APPARATUS

BACKGROUND OF THE INVENTION

1. Field of the Invention

The present invention relates to an application apparatus and an inkjet recording apparatus, and more particularly to an application apparatus and inkjet recording apparatus for applying to a medium a liquid in which a treatment agent having a function of aggregating or insolubilizing a coloring material by reacting with an ink is dissolved.

2. Description of the Related Art

In an inkjet recording apparatus which forms an image by ejecting ink droplets, if a color image is formed by using inks of a plurality of colors, then there is a possibility that color bleeding occurs. Color bleeding of this kind reduces the quality of the image and therefore preventative measures of various kinds have been proposed. As one such measure, a method is known in which a treatment liquid having a function of aggregating or insolubilizing the coloring material in an ink by reacting with the ink is applied previously to a medium, and an image is formed by ejecting ink onto the medium to which this treatment liquid has been applied. According to this method, the coloring material in the ink droplets aggregates immediately after the droplets land on the medium, and therefore even if other ink droplets are ejected onto adjacent positions, there is no combination between the respective coloring materials and it is possible effectively to suppress the occurrence of color bleeding.

The treatment liquid can be applied by using either an application roller or an inkjet head. For instance, an application roller on which treatment liquid has been deposited on the circumferential surface thereof is abutted against the medium and treatment liquid is thereby applied to the medium (see, for example, Japanese Patent Application Publication No. 2007-83180, Japanese Patent Application Publication No. 2007-117806, or Japanese Patent Application Publication No. 2000-37942). Alternatively, treatment liquid is ejected from an inkjet head onto the medium which is traveling, and the treatment liquid is thereby applied to the medium (see, for example, Japanese Patent Application Publication No. 2004-291627).

If an image is formed using a treatment liquid of this kind, then in order to display a sufficient aggregating or insolubilizing action, the treatment liquid should be applied in such a manner that a sufficient amount of the aggregation promoting component or insolubilization promoting component contained in the treatment liquid remains on the medium. Therefore, it is necessary to apply a large amount of treatment liquid in order that a sufficient amount of aggregation promoting component or insolubilization promoting component remains on the medium after application. It is especially necessary to apply a large amount of treatment liquid in cases where the liquid is applied to a medium having high permeability, such as normal paper.

However, if a large amount of treatment liquid is applied to the medium, then there are possibilities that the medium curls and deforms, ultimately causing a decline in the quality of the image.

SUMMARY OF THE INVENTION

The present invention has been contrived in view of the foregoing circumstances, an object thereof being to provide an application apparatus and an inkjet recording apparatus whereby a sufficient amount of active component can be caused to remain on a medium to which it has been applied.

In order to attain an object described above, one aspect of the present invention is directed to an application apparatus comprising: a supply device which supplies a liquid in which a treatment agent having a prescribed function is dissolved; an application device which applies the liquid supplied from the supply device, onto a medium; and a condensing device which condenses the liquid supplied to the application device from the supply device during a period until the liquid is applied to the medium.

According to this aspect of the invention, the liquid supplied from the supply device to the application device is condensed by the condensing device before being applied to the medium (the condensation includes a state in which the treatment agent is solidified). Accordingly, it is possible to cause a larger amount of active component to remain on the medium to which it has been applied. Furthermore, it is possible to keep the liquid in a stable state in the supply device. In other words, a conceivable method of causing a larger amount of the active component to remain on the medium is a method whereby liquid containing treatment agent dissolved to the limit value or above is applied, but with this method, it is difficult to store liquid in a stable state. On the other hand, by condensing the liquid after it has been supplied from the supply device, as in an aspect of the present invention, there is no need to supply liquid containing treatment agent dissolved to the limit value or above in the supply device, and it is possible to keep the liquid in a stable state.

Desirably, the condensing device has a heating device which heats the liquid supplied from the supply device to the application device so as to condense the liquid.

According to this aspect of the invention, the condensing device is constituted by a heating device and evaporation is promoted, thereby condensing the liquid, by heating the liquid which has been supplied from the supply device to the application device.

Desirably, the condensing device has an air blowing device which blows air onto the liquid supplied from the supply device to the application device so as to condense the liquid.

According to this aspect of the invention, the condensing device is constituted by an air blowing device and evaporation is promoted, thereby condensing the liquid, by blowing air onto the liquid which has been supplied from the supply device to the application device.

Desirably, the condensing device has a dehumidification device which dehumidifies ambient environment of the liquid supplied from the supply device to the application device so as to condense the liquid.

According to this aspect of the invention, the condensing device is constituted by a dehumidification device and evaporation is promoted, thereby condensing the liquid, by dehumidifying the ambient environment of the liquid which has been supplied from the supply device to the application device.

Desirably, the condensing device condenses the liquid to a degree equal to or greater than a solubility of the treatment agent.

According to this aspect of the invention, the liquid is condensed by the condensing device to a degree equal to or greater than the solubility of the treatment agent.

Desirably, the condensing device condenses the liquid so that a solvent component is removed from the liquid.

According to this aspect of the invention, the liquid is condensed by the condensing device until the solvent component is removed. In other words, according to this aspect of the present invention, the active component is applied to the medium in a solidified state.

Desirably, the treatment agent has a function of reacting with an ink so as to aggregate or insolubilize a coloring material of the ink.

According to this aspect of the invention, a treatment agent having a function which aggregates or insolubilizes the coloring material of the ink by reacting with the ink is dissolved in the liquid.

Desirably, the liquid contains a high-boiling-point solvent.

According to this aspect of the invention, a high-boiling-point solvent is contained in the liquid. In this way, it is possible to keep the liquid in a stable state in the supply device.

Desirably, the application device is a roller that rotates and abuts against the medium which is traveling so as to apply the liquid deposited on an outer circumferential surface of the roller onto the medium; the supply device deposits the liquid on the outer circumferential surface of the roller so as to supply the liquid; and the condensing device condenses the liquid which has been deposited on the outer circumferential surface of the roller by the supply device, during the period until the liquid is applied to the medium.

According to this aspect of the invention, the application device is constituted by a roller which rotates, abuts against a traveling medium, and applies the liquid deposited on the outer circumferential surface thereof, to the medium. The supply device supplies liquid by depositing liquid onto the outer circumferential surface of the roller, and the condensing device condenses the liquid which has been deposited on the outer circumferential surface of the roller by the supply device, during a period until the liquid is applied to the medium.

Desirably, a circumferential speed of the roller is set to be slower than a speed of the medium which is traveling.

According to this aspect of the invention, the circumferential speed of the roller is set to be slower than the speed of movement of the medium. In this way, it is possible to lengthen the time period until the liquid is applied to the medium, and hence condensation can proceed further.

Desirably, the application apparatus further comprises a re-dissolving device which re-dissolves the liquid remaining on the roller.

According to this aspect of the invention, a re-dissolving device which re-dissolves the liquid remaining on the roller is provided. In this way, further liquid is supplied onto the roller while condensed liquid still remains on the roller, and it is possible to prevent the applied amount of liquid from becoming instable.

In order to attain an object described above, another aspect of the present invention is directed to an image forming apparatus which applies to a medium a liquid in which a treatment agent having a function of reacting with an ink so as to aggregate or insolubilize a coloring material of the ink and ejects the ink onto the medium to which the liquid has been applied in such a manner that an image is formed, the image forming apparatus comprising any one of the application apparatuses as described above which apply the liquid to the medium.

According to this aspect of the invention, the liquid is applied to the medium by using any one of the application apparatuses as described above.

According to the present invention, it is possible to cause a sufficient amount of active component to remain on the medium to which liquid has been applied.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
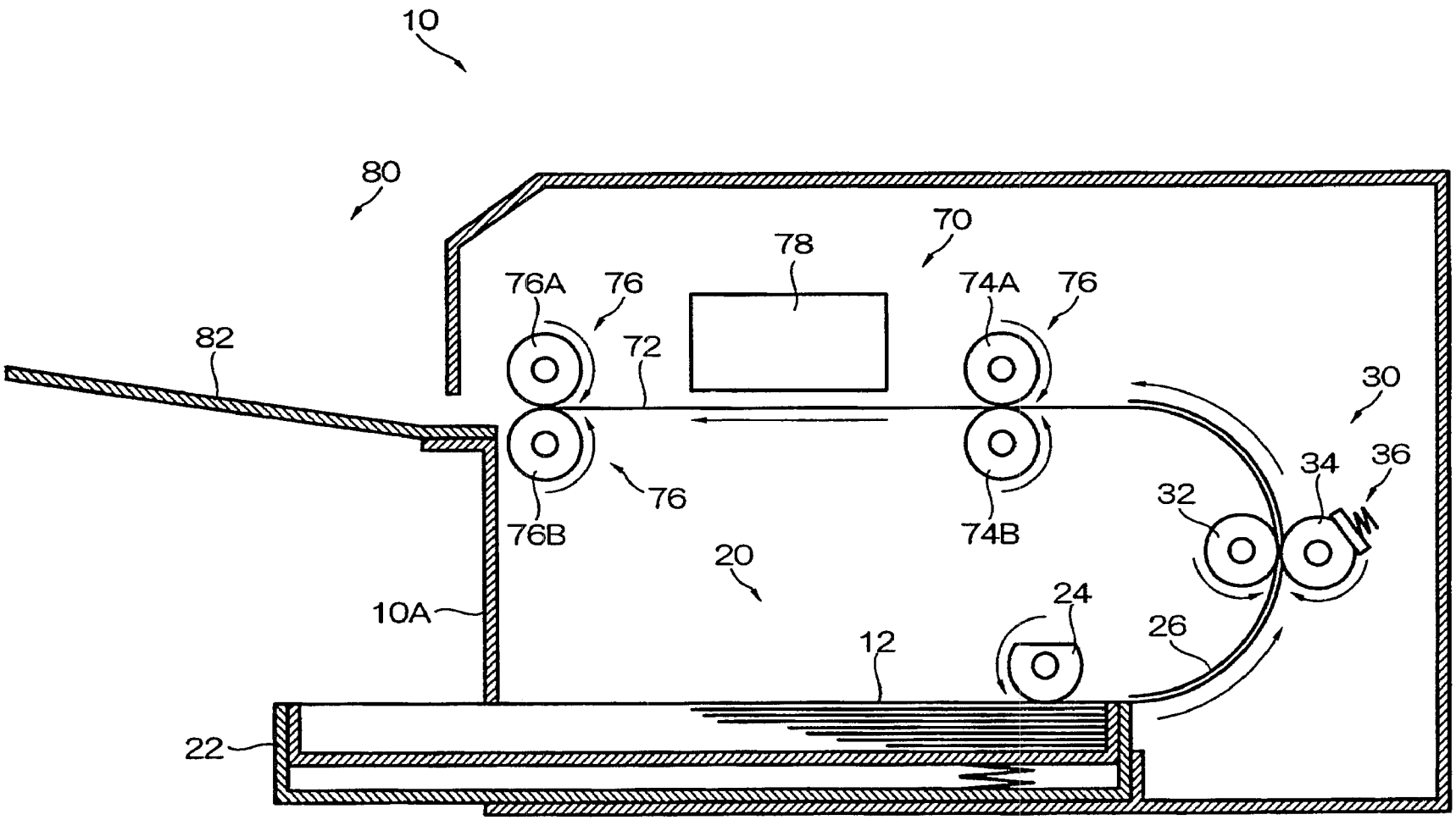
FIG. 1 is a cross-sectional diagram illustrating the approximate composition of an inkjet recording apparatus to which an embodiment of the present invention is applied.

FIG. 1 is a cross-sectional diagram illustrating the approximate composition of an inkjet recording apparatus to which an embodiment of the present invention is applied.

As illustrated in FIG. 1, the inkjet recording apparatus 10 according to the present embodiment is an inkjet recording apparatus which forms an image by ejecting ink droplets onto paper (cut paper) which has been cut to a prescribed size, and comprises: a paper supply unit 20 which supplies paper 12; a treatment liquid application unit (application apparatus) 30 which applies liquid (treatment liquid) having a function of aggregating the coloring material of the ink onto the paper 12 which is supplied from the paper supply unit 20; an image forming unit 70 which forms an image by ejecting ink droplets onto the paper 12 onto which the treatment liquid has been applied; and a paper output unit 80 which outputs the paper 12 on which the image has been formed.

The paper supply unit 20 comprises a paper supply cassette 22 in which the paper 12 is loaded and a paper supply roller 24 which supplies paper 12 that has been loaded in the paper supply cassette 22.

The paper supply cassette 22 is provided detachably on the main body 10A of the inkjet recording apparatus 10. The paper 12 is loaded in a stacked state in the paper supply cassette 22.

The paper supply roller 24 is disposed above the paper supply cassette 22 which is located in a prescribed position. This paper supply roller 24 has a half moon-like shape and rotates by means of being driven by a motor (not illustrated).

Due to the rotation of the paper supply roller 24, the paper 12 which is loaded in the paper supply cassette 22 is supplied in sequence from the top, one sheet at a time, toward a prescribed conveyance path.

The paper 12 which has been supplied from the paper supply unit 20 travels along a conveyance path 26 formed in a circular arc shape, and treatment liquid is applied thereto by the treatment liquid application unit 30 which is provided in the conveyance path 26.

Figure 2:
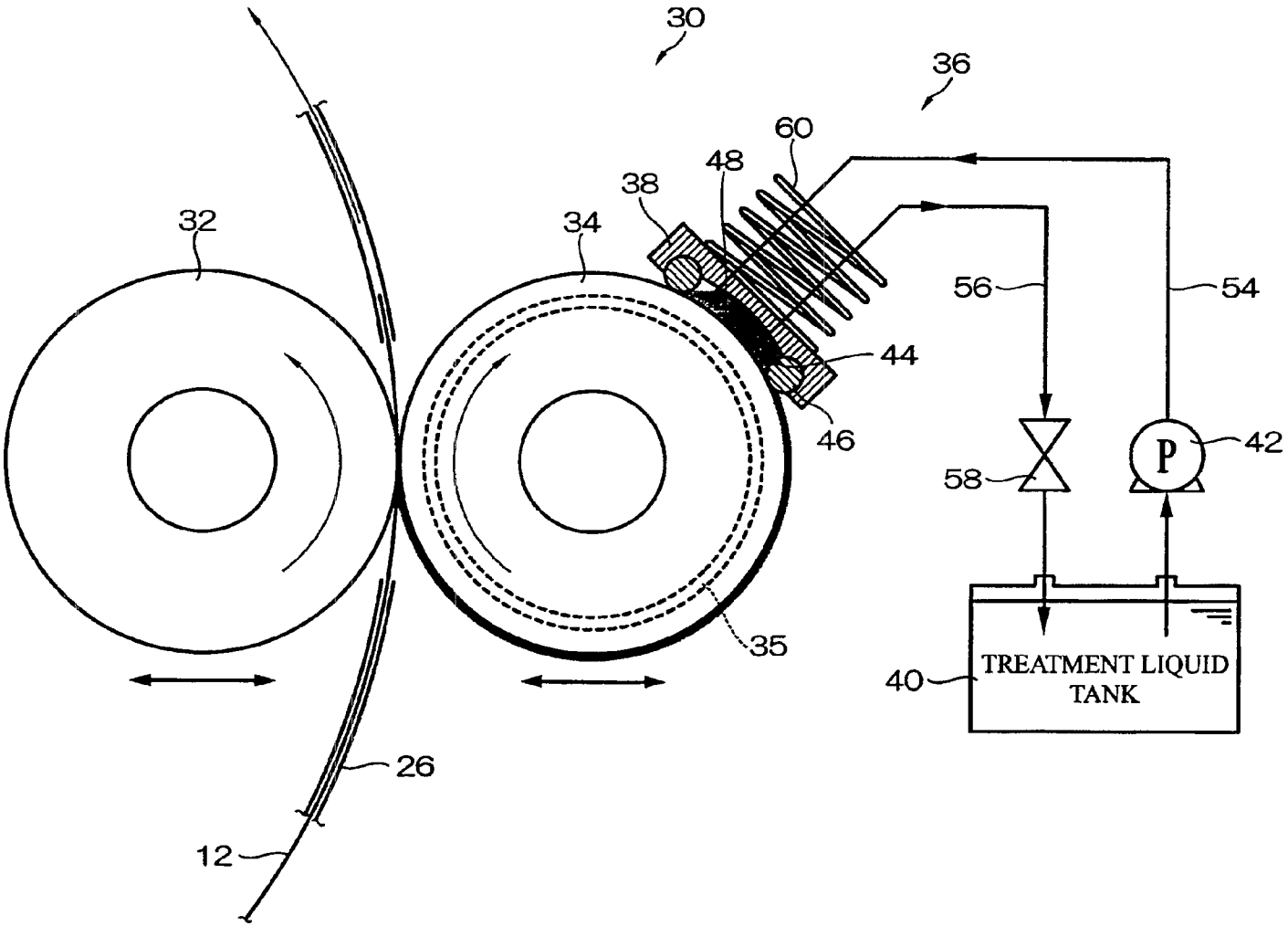
FIG. 2 is a general schematic drawing of a treatment liquid application unit.

The treatment liquid application unit 30 applies, onto the surface (image forming surface) of the paper 12, a liquid (treatment liquid) in which a treatment agent (aggregation promoting agent) having a function of aggregating coloring material by reacting with ink is dissolved. As illustrated in FIG. 2, this treatment liquid application unit 30 comprises a back-up roller 32 which supports the paper 12, an application roller 34 which applies treatment liquid to the paper 12, and a treatment liquid supply unit 36 which supplies the treatment liquid to the application roller 34.

The back-up roller 32 and the application roller 34 are disposed so as to be mutually opposing on either side of the conveyance path 26 of the paper 12. The paper 12 is conveyed while being sandwiched between the back-up roller 32 and the application roller 34, and the treatment liquid supplied to the surface (outer circumferential surface) of the application roller 34 during this conveyance stage is transferred and applied to the image forming surface.

The back-up roller 32 is formed to have a width equal to or greater than the width of the paper 12 (the length thereof in the axial direction), and either end portion thereof is supported rotatably via a bearing on a frame (not illustrated). The frame which supports the back-up roller 32 is provided in an advanceable and retractable fashion at a prescribed stroke with respect to the application roller 34, and is impelled toward the application roller 34 by means of an impelling device (for example, a spring, or the like) which is not illustrated.

Furthermore, the back-up roller 32 has a lyophobic treatment provided on the surface (outer circumferential surface) thereof (for example, a coating of Teflon (registered trademark), or the like), thereby achieving a composition which makes treatment liquid not liable to adhere to the roller.

The application roller 34 is formed at approximately the same width as the back-up roller 32 (the length in the axial direction), and the respective end portions thereof are supported rotatably via bearings on a frame (not illustrated).

The frame which supports the application roller 34 is provided in an advanceable and retractable fashion with respect to the back-up roller 32, and is moved between a prescribed abutting position and a standby position by being driven by an actuator (for example, a cylinder), which is not illustrated. When the frame is moved to the abutting position, it abuts and presses against the surface of the back-up roller 32 and when it is moved to the standby position, it is withdrawn with respect to the back-up roller 32.

Furthermore, a motor (not illustrated) is installed in the frame which supports the application roller 34 and the application roller 34 is driven and caused to rotate by the motor. The paper 12 is conveyed along the conveyance path 26 by the rotation of the application roller 34.

Furthermore, a heater (for example, a halogen heater, or the like) 35 is installed inside the application roller 34 and the surface (outer circumferential surface) of the roller 34 is controlled to a prescribed temperature by this heater 35.

The treatment liquid supply unit 36 supplies treatment liquid at a prescribed thickness to the surface (outer circumferential surface) of the application roller 34. This treatment liquid supply unit 36 comprises a treatment liquid holding block 38 which holds the treatment liquid between itself and the application roller 34, a treatment liquid tank 40 which stores the treatment liquid, and a treatment liquid supply pump 42 which supplies the treatment liquid from the treatment liquid tank 40 to the treatment liquid holding block 38.

Figure 3:
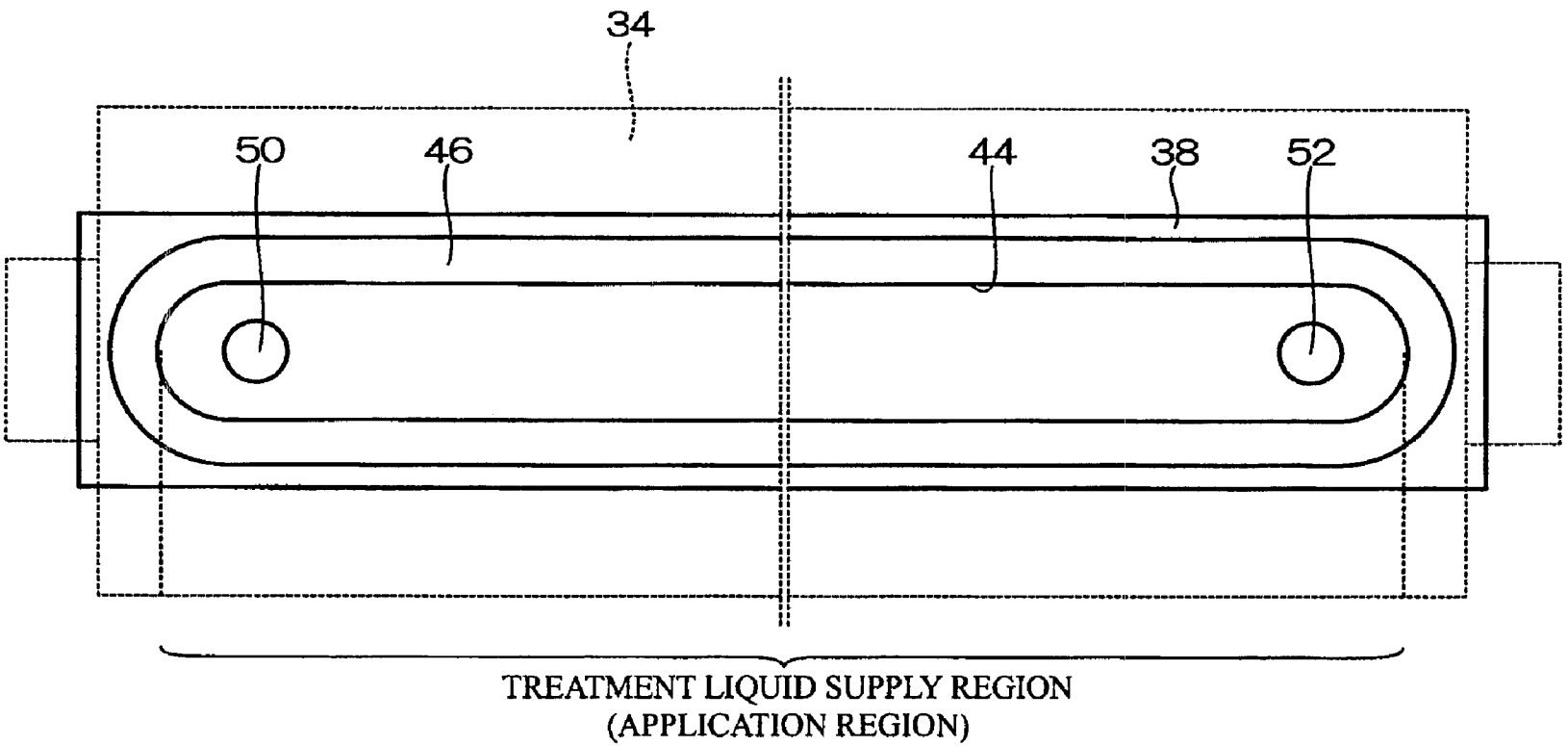
FIG. 3 is a bottom face view of a treatment liquid holding block.

As illustrated in FIG. 3, the treatment liquid holding block 38 is formed in a square plate shape having substantially the same width (length in the lengthwise direction) as the width (length in the axial direction) of the application roller 34, and is provided in parallel with the axis of the application roller 34. The rear surface of the treatment liquid holding block 38 (the surface which opposes the application roller 34) is formed with a recess section 44 having a cross-section in the form of a circular arc. A ring-shaped abutting member 46 is installed so as to surround the edge of the recess section 44.

The abutting member 46 is formed so as to project by a prescribed amount from the rear surface of the treatment liquid holding block 38, and is formed so as to make tight contact with the outer circumferential surface of the application roller 34. The treatment liquid holding block 38 is pressed and abutted against the outer circumferential surface of the application roller 34 via this abutting member 46.

The treatment liquid holding block 38 forms a hermetically closed space 48 between itself and the outer circumferential surface of the application roller 34 by being abutted and pressed against the outer circumferential surface of the application roller 34 via the abutting member 46. In other words, by means of the abutting member 46 abutting and pressing against the outer circumferential surface of the application roller 34, a sealed space 48 is created by means of the recess section 44 formed in the rear surface of the treatment liquid holding block 38 being sealed off by the application roller 34.

Treatment liquid is supplied to this space 48 and the treatment liquid supplied to the space 48 is then supplied to the application roller 34. In other words, when treatment liquid is supplied to the space 48, the treatment liquid is held in a state of contact with the outer circumferential surface of the application roller 34. Consequently, when the application roller 34 rotates in this state, the outer circumferential surface of the application roller 34 makes continuous contact with the treatment liquid. In this way, the treatment liquid is supplied continuously at a prescribed thickness to the outer circumferential surface of the application roller 34.

A treatment liquid supply port 50 and a treatment liquid recover port 52 which are connected to the recess section 44 forming the space 48 are formed in the surface of the treatment liquid holding block 38.

A treatment liquid supply pipe 54 is connected to the treatment liquid supply port 50 and the treatment liquid supply pipe 54 is connected to a treatment liquid tank 40 via a treatment liquid supply pump 42. The treatment liquid stored in the treatment liquid tank 40 is fed to the treatment liquid supply pump 42 and then supplied to the space 48.

On the other hand, a treatment liquid recovery pipe 56 is connected to the treatment liquid recovery port 52 and the treatment liquid recovery pipe 56 is connected via a valve 58 to the treatment liquid tank 40. The treatment liquid supplied to the space 48 is held inside the space 48 by closing off the valve 58, and the treatment liquid is recovered into the treatment liquid tank 40 by opening the valve 58.

The treatment liquid holding block 38 is installed on the frame which supports the application roller 34, and is supported in an advanceable and retractable fashion with respect to the application roller 34. The treatment liquid holding block 38 is also impelled by a spring 60 interposed between it and the frame and is thereby pressed against the outer circumferential surface of the application roller 34 with a prescribed pressing force.

The treatment liquid application unit 30 has the composition described above. The paper 12 is conveyed while being sandwiched between the back-up roller 32 and the application roller 34, and the treatment liquid supplied to the surface of the application roller 34 is transferred and applied to the image forming surface during this conveyance stage.

Here, as described above, the application roller 34 of the present embodiment has a built-in heater 35 and is heated by this heater 35 in such a manner that the surface temperature thereof is controlled to a prescribed temperature. Therefore, when treatment liquid is supplied from the treatment liquid supply unit 36 to the application roller 34, drying (evaporation of solvent) is promoted in the treatment liquid thus supplied, in comparison with an unheated roller. Consequently, the treatment liquid is condensed and the viscosity thereof is increased, up until the time that it is applied to the paper 12.

By applying the treatment liquid to the paper 12 in a state where it has been condensed and the viscosity thereof has been increased in this way, it is possible to cause a larger amount of the active component to remain on the surface of the paper 12.

The application roller 34 is driven in synchronism with the timing of the passage of the paper 12. In other words, normally, the application roller 34 is located at the standby position, and when paper 12 is conveyed to an application position (a position where the application roller 34 having been moved to the abutting position abuts against the back-up roller 32, namely, the position where treatment liquid is applied), then the application roller 34 is moved to the abutting position and treatment liquid is applied to the surface. More specifically, when the leading edge of the application region set on the paper 12 (the region where treatment liquid is to be applied) is conveyed to (passes) the application position, the application roller 34 is moved to the application position in accordance with same, and when the trailing edge of the application region has been conveyed to the application position, the application roller 34 is moved to the standby position. In this way, it is possible to apply treatment liquid to a specified region. Furthermore, in this way, it is also possible to prevent the treatment liquid from adhering to the back-up roller 32.

In order to ensure a reliable reaction with the treatment liquid, the application region is set to be wider than the image forming region (the region where an image is to be formed by depositing ink droplets). The width of this application region is specified by the supply width of treatment liquid supplied to the application roller 34, and the supply width of the treatment liquid supplied to the application roller 34 is specified by the width of the space 48 formed by the treatment liquid supply unit 36 (namely, the width of the recess section 44).

The paper 12 onto which the treatment liquid has been applied is conveyed to the image forming unit 70 where an image is formed by ejecting ink droplets onto the surface of the paper.

As illustrated in FIG. 1, the image forming unit 70 comprises a platen 72, a first conveyance roller pair 74, a second conveyance roller pair 76 and an ink ejection unit 78.

The platen 72 is disposed horizontally. Paper 12 which has been conveyed through the circular arc-shaped conveyance path 26 is mounted on the platen 72.

The first conveyance roller pair 74 and the second conveyance roller pair 76 convey the paper 12 which has been mounted on the platen 72.

The first conveyance roller pair 74 is disposed to the upstream side of the platen 72 in terms of the conveyance direction. This first conveyance roller pair 74 is constituted by a drive roller 74A and an idle roller 74B. The drive roller 74A and the idle roller 74B are disposed in opposing upper and lower positions on either side of the platen 72 and the respective end portions thereof are supported rotatably on bearings (not illustrated) which are provided on the main body 10A of the apparatus. A motor (not illustrated) is coupled to the drive roller 74A and this drive roller 74A is driven so as to rotate by this motor. The paper 12 which has been conveyed along the circular arc shaped conveyance path 26 is mounted on the platen 72 and is supplied between the drive roller 74A and the idle roller 74B of the first conveyance roller pair 74. The paper is gripped between the drive roller 74A and the idle roller 74B of the first conveyance roller pair 74 and is conveyed on the platen 72.

The second conveyance roller pair 76 is disposed to the downstream side of the platen 72 in terms of the direction of conveyance. This second conveyance roller pair 76 is constituted by a drive roller 76A and an idle roller 76B. The drive roller 76A and the idle roller 76B are disposed in opposing upper and lower positions on either side of the platen 72 and the respective end portions thereof are supported rotatably on bearings (not illustrated) which are provided on the main body 10A of the apparatus. The drive roller 76A is coupled to a motor (not illustrated) and is driven so as to rotate by the motor. Paper 12 which has been conveyed over the platen 72 is supplied between the drive roller 76A and the idle roller 76B of the second conveyance roller pair 76. The paper is gripped between the drive roller 76A and the idle roller 76B of the second conveyance roller pair 76 and is conveyed toward the paper output unit 80 which is on the downstream side.

The ink ejection unit 78 ejects ink droplets of the four colors of cyan (C), magenta (M), yellow (Y) and black (K) onto the paper 12 which is conveyed over the platen 72, thereby forming a color image on the surface of the paper 12.

This ink ejection unit 78 comprises independent inkjet heads (not illustrated) for respective colors and the ink droplets of the respective colors are ejected independently and respectively from the corresponding inkjet heads. In other words, cyan ink droplets are ejected from a cyan inkjet head, magenta ink droplets are ejected from a magenta inkjet head, yellow ink droplets are ejected from a yellow inkjet head and black ink droplets are ejected from a black inkjet head, respectively and independently.

Here, the inkjet heads of the respective colors are each respectively constituted by full line type inkjet heads which form an image on the surface of paper 12 by ejecting ink droplets from a nozzle row (a row of nozzles (ink ejection ports) that eject ink droplets) formed on the ink ejection surface (the surface form which ink is ejected) of the head. This nozzle row is formed to a width corresponding to the paper 12. In other words, it is formed to a length which is able to cover the full width of the image forming region set on the paper 12.

Furthermore, the respective inkjet heads have respective nozzle rows disposed so as to intersect with the direction of the conveyance of the paper 12 (sub-scanning direction), and the ink ejection surfaces thereof are disposed so as to maintain a prescribed clearance with respect to the platen 72.

Moreover, the inkjet heads are disposed in a prescribed color sequence at a prescribed interval apart in sequence from the upstream side in terms of the direction of conveyance of the paper 12. For example, the inkjet heads of the respective colors are disposed in the sequence cyan (C), magenta (M), yellow (Y) and black (K) from the upstream side in terms of the direction of conveyance of the paper 12.

When the paper 12 which is being conveyed over the platen 72 passes below the ink ejection unit 78, ink droplets are ejected from the respective inkjet heads and an image is formed on the surface of the paper 12.

Here, since treatment liquid has previously been applied to the surface of the paper 12, then when the ink droplets land on the surface of the paper 12, the coloring material in these ink droplets aggregates due to the action of the treatment liquid. Consequently, it is possible effectively to prevent the occurrence of bleeding, and the like. In other words, when an ink droplet lands on the layer of aggregating treatment agent, the ink droplet lands with a prescribed contact surface area on the layer of aggregating treatment agent, based on a balance between the kinetic energy (flight energy) and the surface energy of the droplet. Such an aggregating reaction starts immediately after the ink droplet has landed on the aggregating treatment agent, but this reaction starts from the contact surface between the ink droplet and the aggregating treatment agent layer. The aggregating reaction occurs only in the vicinity of the contact surface, and the coloring material in the ink aggregates while the contact surface area is kept and the ink droplet (coloring material) receives an adhesive force in the contact surface area upon landing of the ink; therefore, movement of the coloring material is suppressed. Therefore, even if another ink droplet is deposited adjacently to this ink droplet, since the coloring material of the previously deposited ink has already aggregated, then the coloring material does not mix with the subsequently deposited ink, and therefore bleeding is suppressed.

In the present example, a full line type of inkjet head is employed, but it is also possible to use a so-called serial type (shuttle type) of inkjet head (an inkjet head of a type which moves back and forth reciprocally in the main scanning direction).

Furthermore, in the present embodiment, an image is formed by inks of four colors of cyan (C), magenta (M), yellow (Y) and black (K), but the number and combination of the colors of inks used are not limited to these. It is also possible to use light inks, dark inks, special color inks, or the like, in a complementary fashion, according to requirements. For example, it is possible to adopt a composition which additionally comprises inkjet heads for ejecting light inks, such as light cyan, light magenta, and the like. Furthermore, there are no particular restrictions of the sequence in which the inkjet heads of respective colors are arranged.

For the ink liquids, a liquid containing pigment as a coloring material, a resin polymer, a dispersant and a surfactant, and the like, is used.

The paper output unit 80 comprises a paper output tray 82. The paper 12 on which an image has been formed by means of ink droplets being ejected onto the surface thereof by the image forming unit 70 is conveyed to the second conveyance roller pair 76 of the image forming unit 70 and is output to the paper output tray 82.

Figure 4:
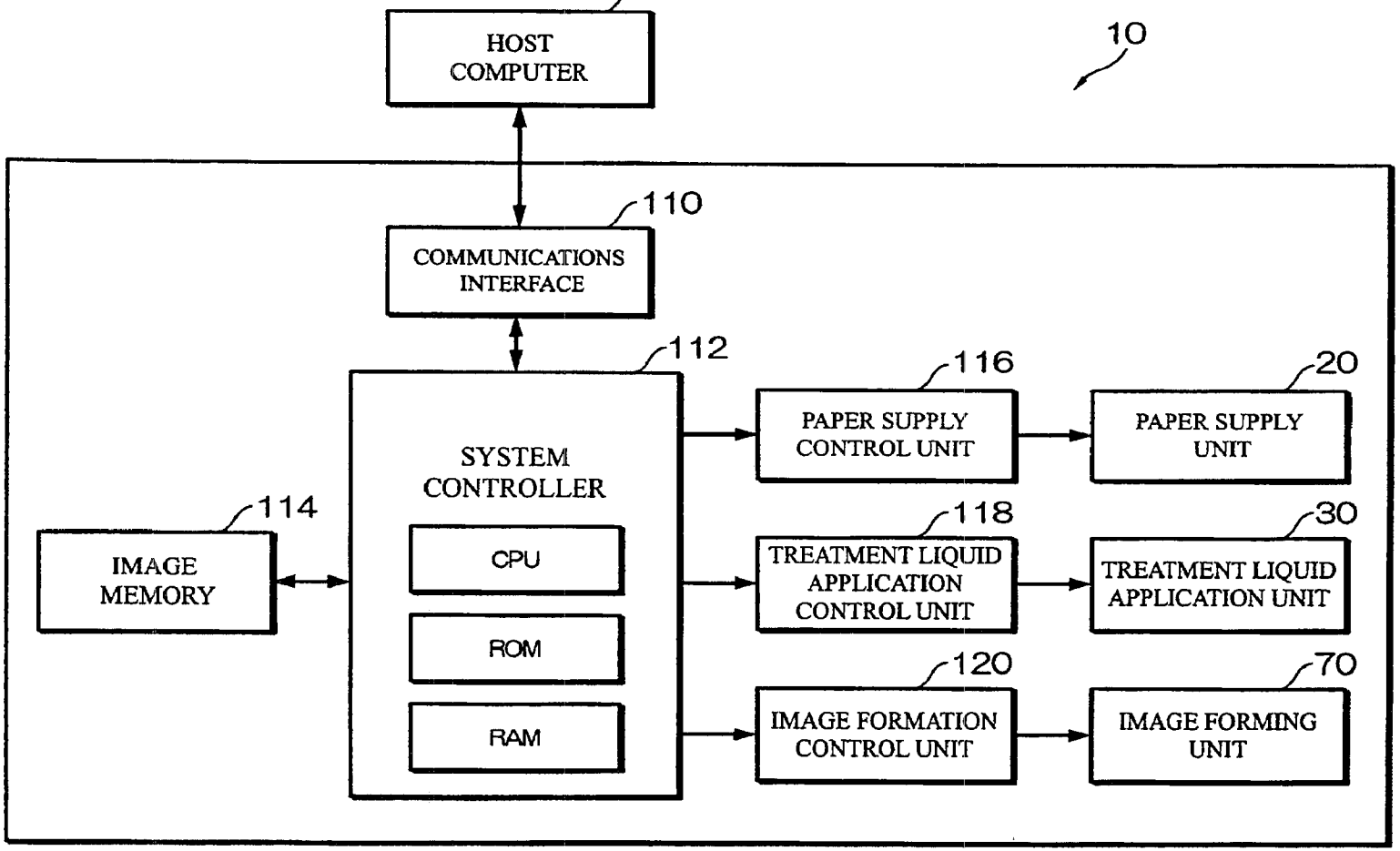
FIG. 4 is a block diagram illustrating the approximate composition of a control system of an inkjet recording apparatus according to an embodiment of the present invention.

FIG. 4 is a block diagram illustrating the approximate composition of a control system in an inkjet recording apparatus according to the present embodiment.

As illustrated in FIG. 4, the inkjet recording apparatus 10 comprises a communications interface 110, a system controller 112, an image memory 114, a paper supply control unit 116, a treatment liquid application control unit 118, an image formation control unit 120, and the like.

The communications interface 110 is an interface unit for receiving image data which is transmitted by a host computer 100. Image data sent by the host computer 100 is read in to the inkjet recording apparatus 10 via this communications interface 110.

The image memory 114 is a storage device which temporarily stores an image input via the communications interface 110, and data is read from and written to the image memory 114 via the system controller 112.

The system controller 112 is a control unit which controls each of units of the inkjet recording apparatus 10 and comprises a CPU, ROM, RAM, and the like. This system controller 112 controls respective sections of the inkjet recording apparatus 10 in accordance with prescribed control programs. The control programs, which are executed by the system controller 112, are stored in the ROM.

The paper supply control unit 116 controls the driving of the paper supply unit 20 in accordance with instructions from the system controller 112. In other words, this control unit controls the driving of the motor connected to the paper supply roller 24, and controls the supply of paper 12 loaded in the paper supply cassette 22.

The treatment liquid application control unit 118 controls the driving of the treatment liquid application unit 30 in accordance with instructions from the system controller 112. In other words, this control unit controls the driving of the motor connected to the application roller 34, thereby controlling the supply of treatment liquid to the application roller 34, as well as controlling the movement of the frame which supports the application roller 34 and thereby controlling the application of treatment liquid to the paper 12. Furthermore, this unit also controls the driving of the treatment liquid supply pump 42 and the valve 58, and thereby controls the supply and recovery of treatment liquid to and from the space 48.

The image formation control unit 120 controls the driving of the image forming unit 70 in accordance with instructions from the system controller 112. In other words, this control unit controls the driving of the motors connected to the first conveyance roller pair 74 and the second conveyance roller pair 76, and thereby controls the conveyance of the paper 12, as well as controlling the driving of the inkjet heads provided in the ink ejection unit 74 so as to form a prescribed image on the paper 12.

The action of the inkjet recording apparatus 10 of the present embodiment which has the composition described above is as follows.

The paper supply cassette 22 in which the paper 12 has been loaded is set in the main body 10A of the apparatus and when the paper supply roller 24 turns, the sheet of paper 12 situated in the uppermost position of the paper supply cassette 22 is supplied toward the conveyance path 26.

The paper 12 which has been supplied from the paper supply cassette 22 travels along the conveyance path 26. Thereupon, when the leading edge of the paper (the leading edge of the application region) which is traveling along the conveyance path 26 reaches the application position, then the frame which supports the application roller 34 is driven and the application roller 34 is abutted against the surface of the traveling paper 12. This application roller 34 has been driven and rotated previously so as to supply treatment liquid to the surface of the roller. Due to the application roller 34 onto which the treatment liquid has been supplied abutting against the paper 12, the treatment liquid is transferred from the application roller 34 and the treatment liquid is applied onto the surface of the paper 12.

The paper 12 onto which the treatment liquid has been applied is output from the conveyance path 26 onto the platen 72. When the paper 12 has been output onto the platen 72, the first conveyance roller pair 74 and the second conveyance roller pair 76 are driven so as to rotate. The paper 12 which has been output onto the platen 72 is thus caused to travel over the platen 72 by the first conveyance roller pair 74 and the second conveyance roller pair 76. Ink droplets are ejected from the ink ejection unit 74 during this conveyance process, thereby forming an image on the surface of the paper 12.

The paper 12 on the surface of which an image has been formed is conveyed by the second conveyance roller pair 76 and is output onto the paper output tray 82.

In this way, in the inkjet recording apparatus 10 according to the present embodiment, a treatment liquid having a function of aggregating the coloring material of ink on the paper 12 is previously applied by the treatment liquid application unit 30, and an image is then formed by ejecting ink droplets onto the paper 12 to which the treatment liquid has been applied.

In the inkjet recording apparatus 10 according to the present embodiment, when applying treatment liquid to the paper 12, treatment liquid is supplied to the surface of the application roller 34 which is rotating, and the treatment liquid is applied to the surface of the paper 12 by abutting this application roller 34 against the surface of the paper 12.

Here, the application roller 34 is heated by the in-built heater 35, and therefore when the treatment liquid is supplied to the surface of the roller, drying (evaporation of the solvent component) of the supplied treatment liquid is promoted, and the active component (the aggregation promoting agent) is condensed by the time that the liquid is applied to the paper 12.

By applying treatment liquid to the paper 12 in a state where the active component has been condensed (the viscosity has been increased) in this way, it is possible to suppress permeation of the liquid into the paper 12, and it is also possible to cause a large amount of the active component to remain on the surface of the paper 12.

By causing a large amount of the active component to remain on the surface of the paper 12 in this way, it is possible to achieve a reliable ink aggregating action and therefore the occurrence of color bleeding can be prevented effectively.

In this way, in the inkjet recording apparatus 10 according to the present embodiment, it is possible to form a satisfactory image by condensing and then applying treatment liquid.

Furthermore, in the inkjet recording apparatus 10 according to the present embodiment, since the treatment liquid is condensed from the time that it is supplied to the application roller 34 until the time that it is applied to the paper 12, then it is possible to keep the treatment liquid in a stable state.

Furthermore, since the treatment liquid is applied to the paper 12 in a condensed state, then it is also possible to prevent curling of the paper 12 due to the solvent component, and the like.

In order to keep the treatment liquid in a stable state, it is desirable that the treatment liquid should contain high-boiling-point solvent. Furthermore, the aggregation promoting agent is desirably dissolved at a lower rate than its solubility limit.

Furthermore, in the present embodiment, a composition is adopted in which the treatment liquid is condensed by heating the application roller 34, but the device for condensing the treatment liquid is not limited to this.

Figure 5:
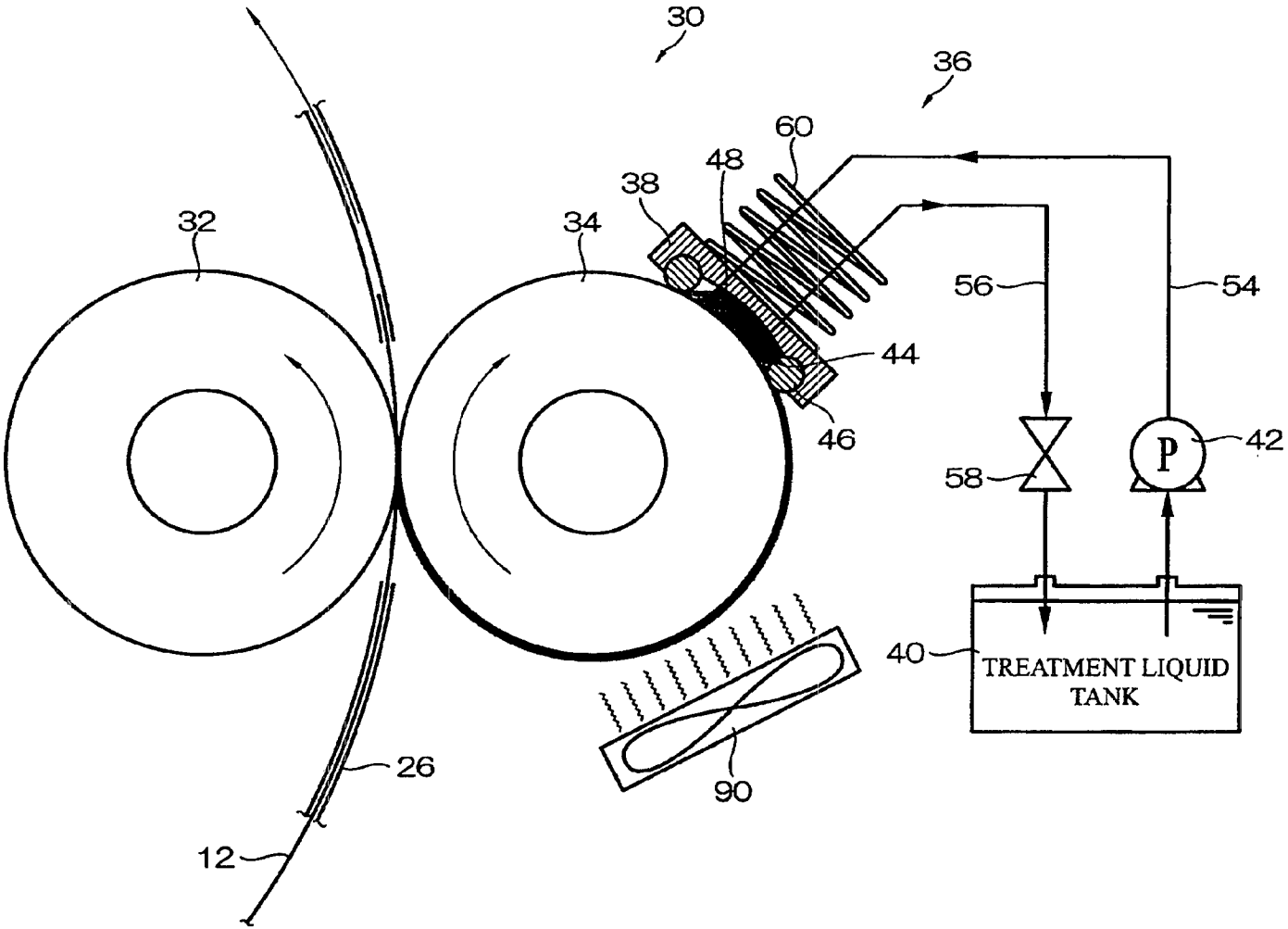
FIG. 5 is a general schematic drawing of a further embodiment of the treatment liquid application unit.

For example, as illustrated in FIG. 5, it is also possible to adopt a composition in which a fan 90 is disposed opposing the application roller 34 and drying is promoted and the treatment liquid is condensed by blowing air onto the treatment liquid which has been supplied to the application roller 34.

Figure 6:
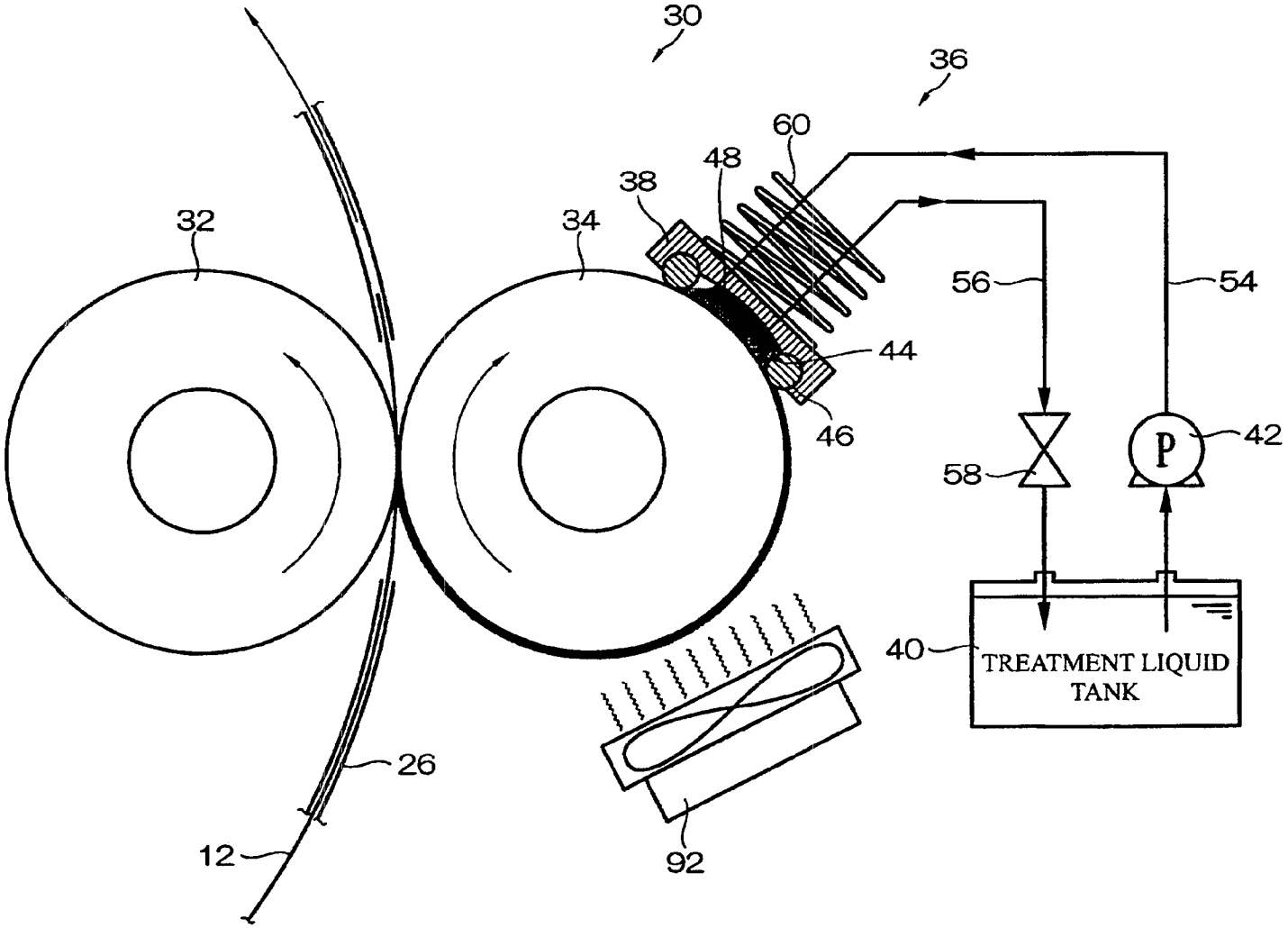
FIG. 6 is a general schematic drawing of a further embodiment of the treatment liquid application unit.

Furthermore, as illustrated in FIG. 6, it is also possible to adopt a composition in which a moisture removal apparatus 92 is disposed in the vicinity of the application roller 34 and drying is promoted and the treatment liquid is condensed by blowing dehumidified air onto the treatment liquid which has been supplied to the application roller 34.

Figure 7:
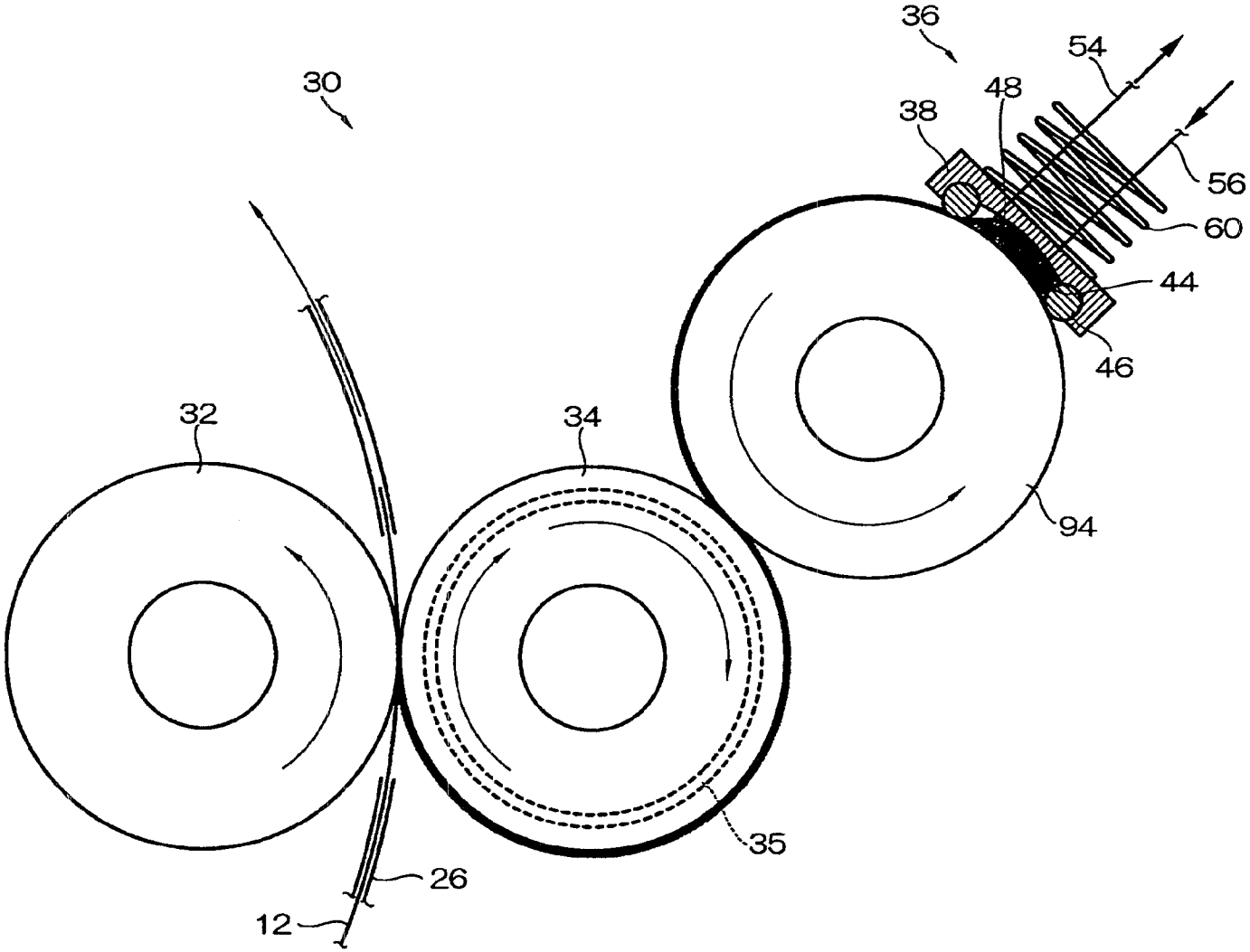
FIG. 7 is a general schematic drawing of a further embodiment of the treatment liquid application unit.

Furthermore, in the present embodiment, the treatment liquid is supplied directly from the treatment liquid supply unit 36 to the application roller 34, but it is also possible to adopt a composition in which treatment liquid is supplied to the application roller 34 via an intermediate roller. For example, as illustrated in FIG. 7, an intermediate roller 94 having the same width as the application roller 34 is provided so as to abut against the outer circumferential surface of the application roller 34, and treatment liquid is supplied to the outer circumferential surface of the intermediate roller 94 from the treatment liquid supply unit 36. In this case, the treatment liquid is firstly supplied from the treatment liquid supply unit 36 to the intermediate roller 94 and is then transferred and supplied from the intermediate roller 94 to the application roller 34 in the abutting section. By adopting a composition according to which the treatment liquid is supplied to the application roller 34 via the intermediate roller 94 in this way, it is possible to lengthen the period from the time at which the treatment liquid is supplied from the treatment liquid supply unit 36 until the time at which the treatment liquid is applied to the paper 12, and hence a sufficient drying time can be ensured before the application of the treatment liquid to the paper.

There are no particular restrictions on the number of intermediately interposed rollers, and this number can be increased appropriately in consideration of the installation space and other factors.

Furthermore, apart from this, it is also possible to adjust the drying time by changing the diameter of the application roller 34.

Moreover, it is also possible to adjust the drying time by adjusting the circumferential speed of the application roller 34. In other words, by slowing the circumferential speed of the application roller 34, it is possible to lengthen the time from the supply of treatment liquid until the application of the treatment liquid, and hence it is possible to ensure a sufficient drying time. In this case, desirably, the circumferential speed of the application roller 34 should be made slower than the conveyance speed of the paper 12.

In this way, there are no particular restrictions on the device which condenses the treatment liquid, and the most suitable device should be used in consideration of the installation space, the composition of the treatment liquid, and other factors.

Furthermore, it is also possible to use a combination of a plurality of devices which condense the treatment liquid. For example, a possible composition is one in which the application roller 34 is heated by a heater, and air propelled by a fan is directed onto the treatment liquid supplied onto the application roller 34, and a further possible composition is one in which, as well as heating the application roller 34 by a heater, air which has been dehumidified by a dehumidifier is directed onto the treatment liquid supplied onto the application roller 34. Furthermore, it is also possible to adopt a composition in which as well as supplying treatment liquid to the application roller 34 via intermediate rollers, the application roller 34 is also heated. By suitably combining heating, air blowing and dehumidification devices, and the like, it is possible to condense the treatment liquid with even better efficiency.

There are no particular restrictions on the extent of the condensation of the liquid, but desirably it is condensed until a state which exceeds the solubility of the aggregation promoting agent (thus creating a state of partial suspension (precipitation)). In other words, the further the condensation of the treatment liquid proceeds, the more possible it becomes to leave active component on the surface of the paper 12 when the liquid is applied to the paper 12, and therefore the treatment liquid should be condensed as far as possible. As a result, ultimately, it is most desirable to remove the solvent component and to apply the treatment agent in a solidified state, but it is also possible to obtain sufficient beneficial effects even if the agent is applied in a state close to a solidified state.

Furthermore, in the present embodiment, the application roller 34 is rotated during standby in such a manner that treatment liquid is supplied continuously to the surface of the application roller 34, but if the application roller 34 is turned idly without making contact with the paper 12, then the aggregating agent precipitates on the surface of the application roller 34 and there is a possibility that the application amount may become instable. Therefore, desirably, it should be possible to re-dissolve the treatment liquid which is returned to the space 48. As a composition for achieving this, for example, it is possible to envisage lowering the solubility of the aggregating agent in the treatment liquid which is supplied to the space 48. In this way, when the treatment liquid supplied to the application roller 34 has performed a full revolution and is returned to the space 48, it is re-dissolved in the treatment liquid held in the space 48 and hence a stabilized supply of the treatment liquid can be achieved.

Figure 8:
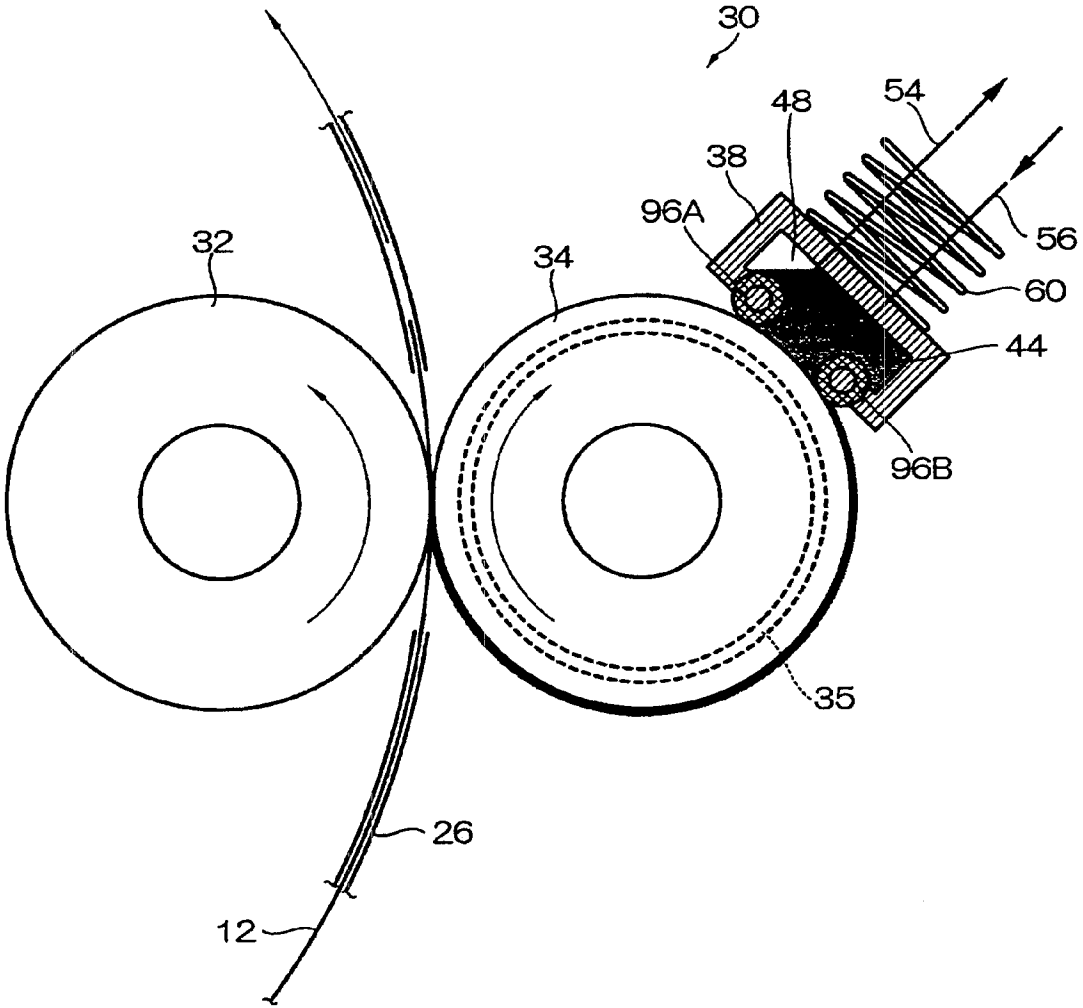
FIG. 8 is a general schematic drawing of a further embodiment of the treatment liquid application unit.

Furthermore, as illustrated in FIG. 8, it is also possible to provide rollers 96A and 96B formed with cells (indentations) in the treatment liquid holding block 38, in such a manner that the treatment liquid remaining on the surface of the application roller 34 is recovered forcibly into the space 48 by these rollers and is re-dissolved. These rollers 96A and 96B are provided on the supply side edge and the recovery side edge of the recess section 44 which constitutes the space 48, and are driven so as to rotate respectively by motors which are not illustrated. When the treatment liquid remaining on the surface of the application roller 34 passes the roller 96A, it is recovered forcibly into the space 48 by the roller 96A which presses and abuts against the surface of the application roller 34, and the treatment liquid is re-dissolved into the treatment liquid held in the space 48. In this way, it is also possible to supply the treatment liquid to the application roller 34 in a more stabilized state.

Similar beneficial effects can be obtained by using a roller with a spiral groove, instead of a roller with a cell (an indentation) of this kind.

Furthermore, it is also possible to provide a blade on the downstream side of the application position in such a manner that the surface of the application roller is cleaned by the blade.

Furthermore, in the present embodiment, the treatment liquid is supplied to the application roller 34 by the treatment liquid supply unit 36, but the device which supplies treatment liquid to the application roller 34 is not limited to this.

Moreover, in the present embodiment, an example is described in which a treatment liquid having an aggregation promoting function is applied to the paper, but there are no particular restrictions on the liquid which is applied by using the application apparatus of an embodiment of the present invention.

As the treatment liquid having an aggregation promoting function, for example, it is possible to use a treatment liquid containing 10 wt % (weight percent) of malonic acid as an aggregation promoting agent, 20 wt % of diethylene glycol monoethyl ether as a high-boiling-point solvent, and 1 wt % of OLFINE E109 as a surfactant, the remainder being made up with deionized water (ion-exchange water).

The treatment liquid (aggregating treatment liquid) which has an aggregation promoting function of this kind, and the ink, are described below.

Treatment Liquid (Aggregating Treatment Liquid)

For the treatment liquid, it is possible to use a treatment liquid which produces an aggregate by causing the pigment and polymer micro-particles contained in the ink to aggregate by changing the pH of the ink.

Desirably, the component of the treatment liquid is selected from amongst: polyacrylic acid, acetic acid, glycol acid, malonic acid, malic acid, malleinic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, cumaric acid, thiophene carboxylic acid, nicotinic acid, and derivatives of these compounds, and salts of these, and the like.

A desirable example of the treatment liquid is a treatment liquid to which a multivalent metal salt or polyallylamine has been added. These compounds may be used singly, or a combination of two or more of these compounds may be used.

From the viewpoint of the pH aggregating performance with respect to the ink, the treatment liquid desirably has a pH of 1 to 6, more desirably, a pH of 2 to 5, and particularly desirably, a pH of 3 to 5.

The added amount, in the treatment liquid, of the compound which causes aggregation of the ink pigment and polymer micro-particles, is desirably equal to or greater than 0.01 wt % and equal to or less than 20 wt %, with respect to the total weight of the liquid. If the amount is equal to or less than 0.01 wt %, then when the ink comes into contact with the treatment liquid, the concentration and dispersion do not advance sufficiently, and a sufficient aggregating action may not be produced by a change in the pH.

The treatment liquid contains a water-soluble high-boiling-point organic solvent having an SP value of 30 or lower at a rate of equal to or greater than 10% and equal to or less than 90%. Examples of a water-soluble high-boiling-point organic solvent having an SP value of 30 or lower are, for instance:

diethylene glycol monoethyl ether (22.4), diethylene glycol monobutyl ether (21.5), triethylene glycol monobutyl ether (21.1), dipropylene glycol monomethyl ether (21.3), and dipropylene glycol (27.2).

[Chemical Formula 1]

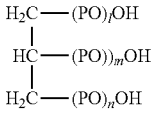

$l + m + n = 3$ (26.4)

[Chemical Formula 2]

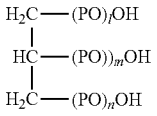

$l + m + n = 4$ (24.9)

[Chemical Formula 3]

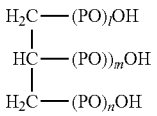

$l + m + n = 5$ (23.9)

[Chemical Formula 4]

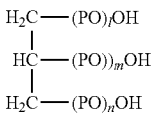

$l + m + n = 6$ (23.2)

-continued

[Chemical Formula 5]

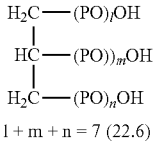

l + m + n = 7 (22.6)

PO = propylene oxy (oxypropylene)

$nC_4H_9O(AO)_4$—H (AO=EO or PO, ratio 1:1) (20.1) EO=ethylene oxy (oxyethylene)

$nC_4H_9O(AO)_{10}$—H (as above) (18.8)

$HO(A'O)_{40}$—H (A'O=EO or PO, ratio EO:PO=1:3) (18.7)

$HO(A''O)_{55}$—H (A"O=EO or PO, ratio EO:PO=5:6) (18.8)

$HO(PO)_3H$ (24.7)

$HO(PO)_7H$ (21.2)

1,2 hexanediol (27.4)

The numbers in parenthesis indicate SP values.

Furthermore, of the solvents having a low SP value, it is desirable to include the following structure.

[Chemical Formula 6]

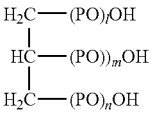

l + m + n = 3-15

The above are possible examples. The SP value (solubility parameter) of the water-soluble high-boiling-point organic solvent described here is a value expressed as the square root of the molecular aggregation energy, and this value can be calculated by the method described in R. F. Fedors in Polymer Engineering Science, 14, p. 147 (1974). The unit is $(MPa)^{1/2}$ and indicates the value at 25° C.

These water-soluble high-boiling-point organic solvents can be used independently, or in plural fashion, together with other organic solvents.

It is also possible to include a resin component in the treatment liquid in order to improve the fixing characteristics and weatherproofing.

The resin component may be an acrylic polymer, a urethane polymer, a polyester polymer, a vinyl polymer, a styrene polymer, or the like. In order to display sufficiently the functions of the material in improving fixing characteristics, it is necessary to add a polymer of relatively high molecule, at a high concentration (1 wt % to 20 wt %). However, if it is sought to add the aforementioned materials by dissolving in the liquid, then the liquid acquires a high viscosity and the ejection characteristics decline. In order to add a suitable material at a high density and suppress increase in the viscosity, it is effective to adopt a device (method) for adding the material in the form of latex. Possible latex materials are, for instance: an alkyl copolymer of acrylic acid, carboxyl-modified SBR (styrene-butadiene latex), SIR (styrene-isoprene latex), MBR (methyl methacrylate-butadiene latex), NBR (acrylonitrile-butadiene latex), and the like. The glass transition point Tg of the latex has a significant effect during the fixing process, and desirably, it is equal to or greater than 50° C. and equal to or less than 120° C., in order to achieve both good stability during storage at normal temperature and good transfer characteristics after heating. Moreover, during the process, the minimum film forming temperature MFT also has a significant effect on fixing and in order to achieve suitable fixing at low temperatures, desirably it is 100° C. or lower, and more desirably, 50° C. or lower.

It is also possible to further increase the aggregating properties by including polymer micro-particles of opposite polarity to the ink and causing the pigment and the polymer micro-particles in the ink to aggregate.

Furthermore, the aggregating properties may be enhanced by including, in the treatment liquid, a curing agent which corresponds to the polymer micro-particle component contained in the ink, in such a manner that the resin emulsion in the ink composition aggregates and produces a cross-linking or polymerization reaction, after the two liquids have come into contact with each other.

The treatment liquid may contain a surfactant.

Desirable examples of the surfactant are: in a hydrocarbon system, an anionic surfactant, such as a salt of a fatty acid, an alkyl sulfate ester, an alkyl benzene sulfonate, an alkyl naphthalene sulfonate, a dialkyl sulfosuccinate, an alkyl phosphate ester, a naphthalene sulfonate/formalin condensate, a polyoxyethylene alkyl sulfuric ester, and the like; and a nonionic surfactant, such as a polyoxyethylene alkyl ether, a polyoxyethylene alkyl aryl ether, a polyoxyethylene fatty acid ester, a sorbitan fatty acid ester, a polyoxyethylene sorbitan fatty acid ester, a polyoxyethylene alkyl amine, a glycerine fatty acid ester, an oxyethylene oxypropylene block copolymer, and the like. Furthermore, it is also desirable to use SURFYNOLS (Air Products & Chemicals, Inc.), which is an acetylene-based polyoxyethylene oxide surfactant. Furthermore, an amine oxide type of amphoteric surfactant, such as N,N-dimethyl-N-alkyl amine oxide, is also desirable.

Moreover, it is also possible to use the surfactants described in pages "(37)" to "(38)" of the Japanese Patent Application Publication No. 59-157636 or Research Disclosure No. 308119 (1989). Furthermore, it is also possible to use a fluorine (alkyl fluoride) type, or silicone type of surfactant such as those described in Japanese Patent Application Publication No. 2003-322926, Japanese Patent Application Publication No. 2004-325707, and Japanese Patent Application Publication No. 2004-309806. It is also possible to use a surface tension adjuster of this kind as an anti-foaming agent; and a fluoride or silicone compound, or a chelating agent, such as EDTA, can also be used.

The surface tension of the treatment liquid is desirably 10 to 50 mN/m, and furthermore, from the viewpoint of simultaneously achieving wetting properties on an intermediate transfer medium, a fine liquid droplet size, and good ejection properties, a surface tension of 15 to 45 mN/m is desirable.

Desirably, the viscosity of the treatment liquid is 1.0 to 20.0 cP.

Additionally, according to requirements, it is also possible to add a pH buffering agent, an antioxidant, an anti-rusting agent, a mildewcide, a viscosity adjuster, a conducting agent, an ultraviolet absorber, and the like.

Ink

For the ink, it is possible to use a water-soluble pigment-based ink which contains, as solvent-insoluble materials, a pigment which is a coloring material (colorant) and polymer micro-particles and the like.

Desirably, the density of the solvent-insoluble material is equal to or greater than 1 wt % and equal to or less than 20 wt %, taking account of the fact that the suitable viscosity for ejection is 20 mPa·s or lower. More desirably, the density of the pigment is 4 wt % or above, in order to obtain good optical density in the image.

Desirably, the surface tension of the ink is equal to or greater than 20 mN/m and equal to or less than 40 mN/m, taking account of ejection stability.

The coloring material used in the ink may be pigment particles or a combination of dye and pigment. From the viewpoint of the aggregating properties upon contact with the treatment liquid, a pigment which is in a dispersed state in the ink is desirable, since this aggregates more effectively. Of pigments, it is particularly desirable to use a pigment which is dispersed by a dispersant, a self-dispersing pigment, a pigment in which the surfaces of the pigment particles are covered with a resin (microcapsule pigment), or a polymer grafted pigment. Furthermore, from the viewpoint of the aggregating properties of the pigment, a more desirable mode is one where the pigment is modified with a carboxyl group having a low degree of disassociation.

There are no particular restrictions on the resin used in a microcapsule pigment, but it is desirable to use a polymer compound having self-dispersing properties or solubility in water, and having an anionic group (acidic properties). Normally, this resin desirably has a numerical average molecular weight in the range of approximately 1,000 to 100,000, and particularly desirably, in the range of approximately 3,000 to 50,000. Furthermore, desirably, the resin is formed as a solution by dissolving in an organic solvent. By setting the numerical average molecular weight of the resin to this range, it is possible to display a satisfactory function as a coating film in the pigment, or as a coating film in the ink composition.

It is possible for the resin to be self-dispersing or soluble, or for these functions to be imparted to the polymer by means of some kind. For example, it is possible to use a resin in which an anionic group such as a carboxyl group, a sulfonate group, a phosphonate group, or the like, has been introduced, by neutralizing with an organic amine or alkali metal. Moreover, it is also possible to use a resin in which one or two or more of the same anionic group or different anionic groups has been introduced. In embodiments of the present invention, it is desirable to use a resin in which a carboxyl group is introduced by neutralizing with a base.

There are no particular restrictions on the pigment used, but possible specific examples of an orange or yellow pigment are, for instance: C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 128, C.I. Pigment Yellow 138, C.I. Pigment Yellow 151, C.I. Pigment Yellow 155, C.I. Pigment Yellow 180, C.I. Pigment Yellow 185, and the like. Possible examples of a red or magenta pigment are, for instance: C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Possible examples of a green or cyan pigment are, for instance: C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Furthermore, possible examples of a black pigment are, for instance: C.I. Pigment Black 1, C.I. Pigment Black 6, C.I. Pigment Black 7, and the like.

Desirably, as a component which reacts with the treatment liquid, polymer micro-particles which do not contain a colorant are added to a coloring ink liquid. The polymer micro-particles enhance the aggregating action and viscosity increasing action of the ink upon reaction with the treatment liquid, and thereby make it possible to improve the image quality. In particular, it is possible to obtain an ink having high stability by including anionic polymer micro-particles in the ink.

By using polymer micro-particles which produce a viscosity increasing action and aggregating action upon reaction with the treatment liquid, it is possible to improve image quality, while at the same time, depending on the type of polymer micro-particles used, beneficial effects are obtained in further improving the weatherproofing and waterproofing properties of the image due to the polymer micro-particles forming a coating on the recording medium.

The method of dispersing in a polymer ink is not limited to an emulsion, and it may be present in the state of a solution or in the state of a colloidal dispersion.

The polymer micro-particles may be dispersed by using an emulsifier, or without using an emulsifier. For the emulsifier, generally, a surfactant of low molecular weight is used, but it is also possible to use a surfactant of high molecular weight as the emulsifier. It is also desirable to use capsule type polymer micro-particles in which the outer shell is made of acrylic acid, methacrylic acid, or the like (namely, core-shell type polymer micro-particles which have a different composition between the central portion and the outer edge portion).

As the dispersion method, polymer micro-particles which do not use a low-molecular weight surfactant include polymer micro-particles using a high-polymer surfactant and polymer micro-particles which do not include an emulsifier, and these are known as a soap-free latex. For example, this includes polymer micro-particles which use, as an emulsifier, a polymer having a group which is soluble in water, such as a sulfonate group, a carboxylic acid group, or the like, as described above (a polymer with a grafted soluble group, or a block polymer obtained from a monomer having a soluble group and a monomer having an insoluble part). In particular, it is desirable to use a soap-free latex, since compared to polymer micro-particles which are polymerized using a conventional emulsifier, a soap-free latex avoids concerns such as the emulsifier obstructing the reaction aggregation and film formation of the polymer micro-particles, and the separated emulsifier moving to the surface after the formation of a film of the polymer micro-particles and reducing the adhesiveness between the aggregate body formed by the combined pigment and polymer micro-particles and the recording medium.

Possible examples of a resin component which is added to the ink in the form of polymer micro-particles include: an acrylic resin, a vinyl acetate resin, a styrene-butadiene resin, a vinyl chloride resin, an acryl-styrene resin, a butadiene resin, a styrene resin, and the like.

A material having a carboxylic acid group with a low degree of disassociation is more desirable, from the viewpoint of imparting fast aggregating properties to the polymer micro-particles. Since the carboxylic acid group is liable to be affected by change in the pH, the state of dispersion is liable to change, and hence the aggregating properties are high.

The change in the state of dispersion of the polymer micro-particles caused by change in the pH can be adjusted by means of the content ratio of the constituent components of the polymer micro-particles which contain a carboxylic acid group, such as ester acrylate, or the like, and it can also be adjusted by means of an anionic surfactant which is used as a dispersant.

Desirably, the resin component of the polymer micro-particles is a polymer which combines a hydrophilic part and a hydrophobic part. By incorporating a hydrophobic part, the hydrophobic part is oriented toward to the inner side of the polymer micro-particle, and the hydrophilic part is oriented efficiently toward the outer side, thereby having the effect of further increasing the change in the dispersion state caused by change in the pH of the liquid. Therefore, aggregation can be performed more efficiently.

Desirably, a carboxylic acid polymer is used as an acid polymer.

Since the pKa of carboxylic acid is approximately 3 to 4, then if the pH is 5, the acid polymer assumes an almost separated state and therefore has stable dispersion characteristics due to electric repulsion, and aggregation does not occur. If the pH is lower than this, then the polymer assumes a non-separated state, the electric repulsion is lost and aggregation arises.

Examples of commercial polymer micro-particles include: Joncryl 537, 7640 (a styrene-acrylic resin emulsion, made by Johnson Polymer Corp.), Microgel E-1002, E-5002 (a styrene-acrylic resin emulsion, made by Nippon Paint Co., Ltd.), Boncoat 4001 (an acrylic resin emulsion, made by DIC Corporation), Boncoat 5454 (a styrene-acrylic resin emulsion, made by DIC Corporation), SAE-1014 (a styrene-acrylic resin emulsion, made by Zeon Corporation), Jurymer ET-410, FC-30, (an acrylic resin emulsion, made by Nihon-junyaku Co., Ltd.), Aron HD-5, A-104 (an acrylic resin emulsion, made by Toagosei Co., Ltd.), Saibinol SK-200 (an acrylic resin emulsion, made by Saiden Chemical Industry Co., Ltd.), "Zaicsen" L, (an acrylic resin emulsion, made by Sumitomo Seika Chemicals Co., Ltd.), and the like, but the polymer micro-particles are not limited to these products.

The weight ratio of the added amount of polymer micro-particles with respect to the pigment is desirably from 2:1 to 1:10, and more desirably, from 1:1 to 1:3. If the weight ratio of the added amount of polymer micro-particles with respect to the pigment is smaller than 2:1, then the aggregating force of the aggregate body is not increased effectively by the fusion of the resin. Moreover, even if the added amount is greater than 1:10, the viscosity of the ink becomes too high and the ejection reliability and other factors deteriorate.

In view of the adhesive force when the polymer micro-particles fuse, it is desirable that the molecular weight of the polymer micro-particles added to the ink should be 5,000 or greater. If the molecular weight is less than 5,000, then insufficient effects are obtained in increasing the internal aggregating force of the ink aggregate body when aggregation occurs, or improving the fixing properties of the image to the recording medium, and furthermore, the effects in improving image quality are inadequate.

Desirably, the volume-average particle size (diameter) of the polymer micro-particles is in the range of 10 nm to 1 μm, more desirably, the range of 10 to 500 nm, even more desirably, the range of 20 to 200 nm, and particularly desirably, the range of 50 to 200 nm. If the particle size is less than 10 nm, then significant effects in improving the image quality or enhancing transfer characteristics cannot be expected, even if aggregation occurs. If the particle size is equal to or greater than 1 μm, then there is a possibility that the ejection characteristics from the ink head or the storage stability deteriorate. Furthermore, there are no particular restrictions on the volume-average particle size distribution of the polymer particles; therefore, they may have a broad volume-average particle size distribution, or they may have a mono-disperse volume-average particle size distribution.

Moreover, two or more types of polymer micro-particles may be used in combination in the ink.

It is possible to use an organic salt or an inorganic alkaline base as a neutralizing pH adjuster which is added to the ink. Desirably, a pH adjuster is added so as to adjust the ink to a pH of 6 to 10, in order to improve the storage stability of the inkjet ink.

The water-soluble high-boiling-point organic solvent having an SP value of 30 or lower is contained at a rate of 10 wt % to 90 wt % with the object of preventing blockages of the nozzles of the inkjet head due to drying. Moreover, by including the aforementioned water-soluble high-boiling-point organic solvent at a rate in the range of 10% to 30%, particularly desirable results are obtained in terms of landing interference, image deformation, and small dot white spot reproducibility, and furthermore, the lightfastness of the formed image is good.

A water-soluble high-boiling-point organic solvent of this kind includes a moistening agent or a penetrating agent. Similarly to the case of the treatment liquid, water-soluble high-boiling-point organic solvents having an SP value of 30 or lower include, for instance:

diethylene glycol monoethyl ether (22.4),
diethylene glycol monobutyl ether (21.5),
triethylene glycol monobutyl ether (21.1),
dipropylene glycol monomethyl ether (21.3),
and dipropylene glycol (27.2).

[Chemical Formula 1]

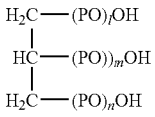

l + m + n = 3 (26.4)

[Chemical Formula 2]

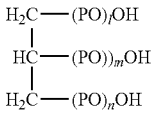

l + m + n = 4 (24.9)

[Chemical Formula 3]

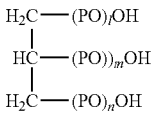

l + m + n = 5 (23.9)

[Chemical Formula 4]

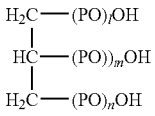

l + m + n = 6 (23.2)

[Chemical Formula 5]

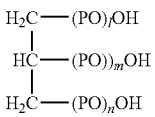

l + m + n = 7 (22.6)

PO = propylene oxy (oxypropylene)

$nC_4H_9O(AO)_4$—H (AO=EO or PO, ratio 1:1) (20.1)
EO=ethylene oxy (oxyethylene)

$nC_4H_9O(AO)_{10}$—H (as above) (18.8)

$HO(A'O)_{40}$—H (A'O=EO or PO, ratio EO:PO=1:3) (18.7)

$HO(A''O)_{55}$—H (A''O=EO or PO, ratio EO:PO=5:6) (18.8)

$HO(PO)_3H$ (24.7)

$HO(PO)_7H$ (21.2)

1,2 hexanediol (27.4)

The numbers in parenthesis indicate SP values.

Furthermore, of the solvents having a low SP value, it is desirable to include the following structure.

[Chemical Formula 6]

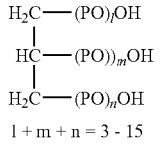

$l + m + n = 3 - 15$

The above are possible examples.

The ink may also contain a surfactant. Desirable examples of the surfactant are: in a hydrocarbon system, an anionic surfactant, such as a salt of a fatty acid, an alkyl sulfate ester, an alkyl benzene sulfonate, an alkyl naphthalene sulfonate, a dialkyl sulfosuccinate, an alkyl phosphate ester, a naphthalene sulfonate/formalin condensate, a polyoxyethylene alkyl sulfuric ester, and the like; and a non-ionic surfactant, such as a polyoxyethylene alkyl ether, a polyoxyethylene alkyl aryl ether, a polyoxyethylene fatty acid ester, a sorbitan fatty acid ester, a polyoxyethylene sorbitan fatty acid ester, a polyoxyethylene alkyl amine, a glycerine fatty acid ester, an oxyethylene oxypropylene block copolymer, and the like. Furthermore, it is also desirable to use SURFYNOLS (Air Products & Chemicals, Inc.), which is an acetylene-based polyoxyethylene oxide surfactant. Furthermore, an amine oxide type of amphoteric surfactant, such as N,N-dimethyl-N-alkyl amine oxide, is also desirable.

Moreover, it is also possible to use the surfactants described in pages "(37)" to "(38)" of the Japanese Patent Application Publication No. 59-157636 or Research Disclosure No. 308119 (1989). Furthermore, it is also possible to use a fluorine (alkyl fluoride) type, or silicone type of surfactant such as those described in Japanese Patent Application Publication No. 2003-322926, Japanese Patent Application Publication No. 2004-325707, and Japanese Patent Application Publication No. 2004-309806. It is also possible to use a surface tension adjuster of this kind as an anti-foaming agent; and a fluoride or silicone compound, or a chelating agent, such as EDTA, can also be used.

By reducing the surface tension, it is possible to improve the wetting properties on the layer of solid or semi-solid aggregating treatment liquid, and thus to increase the rate of spreading.

More desirably, the surface tension of the ink is 15 to 45 mN/m, from the viewpoint of simultaneously achieving good wetting properties on an intermediate transfer medium when recording by an intermediate transfer method, as well as finer size of the liquid droplets and good ejection characteristics.

Desirably, the ink viscosity is 1.0 to 20.0 cP.

Additionally, according to requirements, it is also possible to add a pH buffering agent, an antioxidant, an anti-rusting agent, a mildewcide, a viscosity adjuster, a conducting agent, an ultraviolet absorber, or the like.

Moreover, in the present embodiment, an example is described in which treatment liquid having an aggregation promoting function is applied to the paper, but there are no particular restrictions on the application of an embodiment of the present invention. Embodiments of the invention can also be applied generally to an application apparatus which applies a liquid in which a treatment agent having a prescribed function has been dissolved, to a medium.

Furthermore, in the embodiment described above, an example is given in which the application apparatus relating to an embodiment of the present invention is used in an inkjet recording apparatus, but such an application apparatus relating to an embodiment of the present invention can be applied to other apparatuses.

Moreover, in the embodiment described above, an example is given in which treatment liquid is applied to paper, but there are no particular restrictions on the object (medium) onto which the treatment liquid is applied. Various media can be used as the object medium, such as normal paper, a recording medium having an ink receiving layer, or a recording sheet which is permeable to air in the thickness direction, such as processed paper, or a flexible medium which is not permeable to air, such as an OHP sheet. A particularly effective action is obtained if the medium has good permeability to air, and embodiments of the present invention display most beneficial effects, when an aggregating treatment liquid is applied to a medium of this kind.

Furthermore, in the embodiments described above, an example is given in which an embodiment of the present invention is applied to an inkjet recording apparatus which forms an image only on one surface of paper, but embodiments of the present invention may also be applied in a similar fashion to an inkjet recording apparatus which forms images on both surfaces of paper.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An application apparatus comprising:

a supply device which supplies a liquid in which a treatment agent having a prescribed function is dissolved;

an application device which applies the liquid supplied from the supply device, onto a medium; and a condensing device which condenses the liquid supplied to the application device from the supply device during a period until the liquid is applied to the medium, wherein:

the application device is a roller that rotates and abuts against the medium which is traveling so as to apply the liquid deposited on an outer circumferential surface of the roller onto the medium;

the supply device deposits the liquid on the outer circumferential surface of the roller so as to supply the liquid; and the condensing device is provided after a position where the supply device supplies the liquid and before a position where the application device applies the liquid onto the medium in such a manner that the condensing device condenses the liquid which has been deposited on the outer circumferential surface of the roller by the supply device, during the period until the liquid is applied to the medium.

2. The application apparatus as defined in claim 1, wherein the condensing device has a heating device which heats the liquid supplied from the supply device to the application device so as to condense the liquid.

3. The application apparatus as defined in claim 1, wherein the condensing device has an air blowing device which blows air onto the liquid supplied from the supply device to the application device so as to condense the liquid.

4. The application apparatus as defined in claim 1, wherein the condensing device has a dehumidification device which dehumidifies ambient environment of the liquid supplied from the supply device to the application device so as to condense the liquid.

5. The application apparatus as defined in claim 1, wherein the condensing device condenses the liquid to a degree equal to or greater than a solubility of the treatment agent.

6. The application apparatus as defined in claim 1, wherein the condensing device condenses the liquid so that a solvent component is removed from the liquid.

7. The application apparatus as defined in claim 1, wherein the treatment agent has a function of reacting with an ink so as to aggregate or insolubilize a coloring material of the ink.

8. The application apparatus as defined in claim 1, wherein the liquid contains a high-boiling-point solvent.

9. The application apparatus as defined in claim 1, wherein a circumferential speed of the roller is set to be slower than a speed of the medium which is traveling.

10. The application apparatus as defined in claim 1, further comprising a re-dissolving device which re-dissolves the liquid remaining on the roller.

11. An image forming apparatus which applies to a medium a liquid in which a treatment agent having a function of reacting with an ink so as to aggregate or insolubilize a coloring material of the ink and ejects the ink onto the medium to which the liquid has been applied in such a manner that an image is formed, the image forming apparatus comprising the application apparatus as defined in claim 1 which applies the liquid to the medium.

* * * * *